US011604031B2

(12) United States Patent
Clark

(10) Patent No.: US 11,604,031 B2
(45) Date of Patent: Mar. 14, 2023

(54) SAFETY BUFFERED MULTI-FLUID HEAT EXCHANGER AND SAFETY BUFFERED MULTI-FLUID HEAT EXCHANGE PROCESS

(71) Applicant: Clark Solutions LLC, Boca Raton, FL (US)

(72) Inventor: Nelson Perella Clark, Sao Paulo (BR)

(73) Assignee: Clark Solutions LLC, Boca Raton, FL (US)

( * ) Notice: Subject to any disclaimer, the term of this patent is extended or adjusted under 35 U.S.C. 154(b) by 0 days.

(21) Appl. No.: 17/636,442

(22) PCT Filed: Sep. 25, 2020

(86) PCT No.: PCT/BR2020/050380
§ 371 (c)(1),
(2) Date: Feb. 18, 2022

(87) PCT Pub. No.: WO2021/056089
PCT Pub. Date: Apr. 1, 2021

(65) Prior Publication Data

US 2022/0290923 A1 Sep. 15, 2022

(30) Foreign Application Priority Data

Sep. 27, 2019 (BR) ..... BR1020190202939

(51) Int. Cl.
*F28D 15/00* (2006.01)
*F28D 1/02* (2006.01)
(Continued)

(52) U.S. Cl.
CPC ..... *F28D 1/0226* (2013.01); *F28D 7/16* (2013.01); *F28D 21/00* (2013.01); *F28D 2021/0022* (2013.01)

(58) Field of Classification Search
CPC ..... F28D 1/0226; F28D 7/16; F28D 21/00; F28D 2021/0022
(Continued)

(56) References Cited

U.S. PATENT DOCUMENTS

2019/0202694 A1 7/2019 Clark

FOREIGN PATENT DOCUMENTS

| | | | |
|---|---|---|---|
| CA | 2186557 | A1 | 3/1997 |
| CN | 204142047 | U | 2/2015 |
| EP | 2531446 | B1 | 12/2012 |

OTHER PUBLICATIONS

Clark et al, "SAFEHR: Mutually Increasing Safety and Heat Recovery in Sulfuric Acid Plants", Oct. 17, 2019, Publisher: Sulphur, 2018, International Conference & Exhibition, Published in: Brazil.

*Primary Examiner* — Davis D Hwu
(74) *Attorney, Agent, or Firm* — GableGotwals

(57) ABSTRACT

A buffered multi-fluid heat exchanger and a buffered multi-fluid heat exchange process pertaining to the heat exchange equipment and process sector is disclosed. The heat exchanger (1) comprises a lower tubing or tube bundles (2) through which flows hot process fluid "Q" to be cooled; upper tubing or tube bundles (3) through which flows cold process fluid "F" to be heated, parallel to and spaced apart from the lower tubing (2); a vessel (4) for the tubing (2, 3) provided with inlet (2') and outlet (2") nozzles of the tubing (2), inlet (3') and outlet (3") nozzles of the tubing (3), and a portion of buffer fluid "T" that fills part of the vessel (4) that covers the lower tubing (2) through which circulates the hot process liquid "Q" to be cooled.

8 Claims, 8 Drawing Sheets

(51) Int. Cl.
*F28D 7/16* (2006.01)
*F28D 21/00* (2006.01)

(58) Field of Classification Search
USPC ..... 165/104.19
See application file for complete search history.

STATE OF THE ART

STATE OF THE ART

SAFETY BUFFERED MULTI-FLUID HEAT EXCHANGER AND SAFETY BUFFERED MULTI-FLUID HEAT EXCHANGE PROCESS

CROSS-REFERENCE TO RELATED APPLICATIONS

This United States application is the National Phase of PCT Application No. PCT/BR2020/050380 filed 25 Sep. 2020, which claims priority to Brazilian Patent Application No. BR1020190202939 filed 27 Sep. 2019, each of which is incorporated herein by reference.

The present disclosure relates to a patent application for a buffered multi-fluid heat exchanger, and a multi-fluid heat exchange process, pertaining to the field of thermal exchange equipment and processes, which have been developed to provide increased safety, greater simplicity and lower cost over the conventional equipment and processes.

DESCRIPTION OF THE RELATED ART

In the chemical process industry, it is often necessary to heat or cool fluids in heat exchangers. These devices consist of vessels where two or more fluids indirectly contact with each other, and transfer heat from the hot fluid to the cold fluid.

In various situations, these devices may be employed to chemically process incompatible fluids, whose contact can lead to exothermic chemical reactions, explosions, formation of by-products, unwanted products or even the loss of the products being heated or cooled.

Typical examples of this type of situation is cooling sulfuric or phosphoric add with water, substances which, when in direct contact react thoroughly and generate heat and an extremely corrosive dilute solution. Cooling hydrocarbons that are soluble between them may lead, in case they are mixed, to the production of hard-to-separate mixtures, and also loss of products and other similar situations.

In some situations, it is a requirement that the cold fluid does not reach high temperatures in order to avoid its thermal decomposition. A typical example of this system are the reboilers of amines and glycols in the petrochemical industry.

In order to avoid this kind of problem, the cooling process is usually carried out through systems featuring multiple heat exchangers in order to prevent contact of the fluids, in case of a malfunction, thus minimizing the damage that could be caused and preventing the cold fluid from being subjected to high temperatures that can cause their decomposition.

This is the typical case of so-called "trim coolers" that are used, for example, in the sulfuric acid industry for heating boiler water (FIG. 15). According to this arrangement, in case a heat exchanger shows a malfunction, the process fluids, i.e. sulfuric acid and deionized boiler water will not come into direct contact preventing boiler water contamination.

Another system that attempts to avoid this contact is disclosed in PCT BR 2016 050287, of the same applicants, wherein both process fluids, the one to be heated and the one to be cooled, circulate in respective circuits, and a fluid that is inert to process fluids is circulated in an intermediate circuit provided for heat exchange, so that in case of malfunction or leakage, the process fluids are not contaminated (FIG. 16), and wherein, unlike conventional systems, the unit can be kept in operation or shutdown under normal regime.

For example, in the sulfuric acid industry, hot sulfuric acid at temperatures greater than 180° C. is cooled in water boilers; the contact of these fluids under operating conditions resulted in important exothermic reactions with substantial damage to the equipment, and industrial assets, and compromising the safety of the operators.

To avoid amine degradation in oil processing industry, the reboiler surface temperatures should be kept below 165° C.

Objects of the Invention

An object of the present invention is to provide a new modeling for a heat exchange device (heat exchanger), which eliminates the need for systems featuring multiple heat exchangers ("trim coolers"), said heat exchanger using an intermediate fluid, called "buffer fluid."

Another object of the invention is to provide a heat exchanger that carries out a reliable heat exchange between two or more incompatible process fluids, using a buffer fluid with suitable physicochemical characteristics with respect to the process fluids such that the operation safety is increased.

Another object is to provide a heat exchanger that minimizes the cold fluid decomposition, using a buffer fluid with suitable physicochemical characteristics with respect to the process fluids such that a certain film temperature for the cold fluid is secured.

Another object is to provide a heat exchanger that is relatively simple to build and manufacture.

Another object is to provide a heat exchanger with low manufacturing, acquisition, operation and maintenance costs.

Another object is to provide a thermal exchange process carried out by the heat exchanger.

Another object is to provide a thermal exchange process that offers less cost, greater safety and operational simplifications than those using one or more heat exchangers that work with incompatible fluids.

BRIEF DESCRIPTION OF THE INVENTION

Therefore, in view of the shortcomings of the prior art, and in order to overcoming them and accomplishing the related objects of the invention, the heat exchanger of the present patent application has been developed, whose novel characteristic resides in that it utilizes three or more fluids, wherein two or more fluids are heating/cooling process fluids, and one fluid is a "buffer fluid" that conveys heat between the two or more process fluids; said buffer fluid being selected or formulated based on its characteristics of chemical compatibility with the other fluids, boiling temperature, viscosity, density, and chemical compatibility with the materials of the process equipment under operating conditions.

In a system with three fluids, for example: a hot process fluid to be cooled, a cold process fluid to be heated and the buffer fluid, the safety buffered multi-fluid heat exchanger of the invention consists essentially of the following: a pressure vessel; two tube bundles through which the cold fluid and the hot fluid flow, parallel to and located inside the vessel; a space inside the vessel in which the tube bundles are arranged, and a buffer fluid portion that partially fills the inner space, and covers the tube bundle through which the heated process fluid flows, such that a heat exchange process substantially comprising the following steps is carried out: heat exchange of the hot process fluid with the buffer fluid; evaporation of the buffer fluid; heat exchange between the buffer fluid vapor and the cold process fluid; condensation of the buffer fluid; heat exchange between the condensed buffer fluid and the hot process fluid, and the start of a new cycle.

The heat exchanger so constructed and the heat exchange process carried out by it overcome the above-mentioned shortcomings of the state of the art. Therefore, the heat exchanger so constructed and the heat exchange process carried out by it requires no systems with multiple heat exchangers, such as those used, for example, in the sulfuric acid industry for heating boiler water, as it prevents the direct contact of the process fluids, i.e. sulfuric acid and deionized boiler water, in case of malfunction of a heat exchanger, which could cause boiler water contamination, accelerated corrosion, and risk to safety due to hydrogen formation, and at the same time said heat exchanger and process have a relatively simpler construction, thus meeting the object of the invention.

The heat exchanger so constructed and the heat exchange process carried out by it prevents the cold fluid from being subjected to high temperatures that could cause its decomposition, since, regardless of the temperature of the hot fluid, the cold fluid will only be subject to the boiling temperature of the buffer fluid, which will be selected to ensure this performance.

The present heat exchanger and process is an alternative to the system described in PCT BR 2016050287, in the name of the same applicant, as it simplifies the construction thereof, in which the process fluids, i.e. the one to be heated and the one to be cooled, circulate in respective heat exchangers, and a fluid that is inert to the process fluids circulates in a third intermediate heat exchanger, providing the heat exchange, since the entire construction is simplified by the present heat exchanger formed by a tube bundle for the heated process fluid, a tube bundle for the cooled process fluid, and simply by a buffer fluid portion that performs heat exchange between the process fluids, thus meeting another object of the invention.

In addition to the above advantages, the present heat exchanger and process carried out by it have less manufacturing, acquisition, operation, and maintenance costs when compared to the state of the art, thus meeting other objects of the invention.

LIST OF DRAWINGS

The accompanying drawings relate to the safety buffered multi-fluid heat exchanger, and safety buffered multi-fluid heat exchange process, objects of the present patent, in which.

Figure 7:
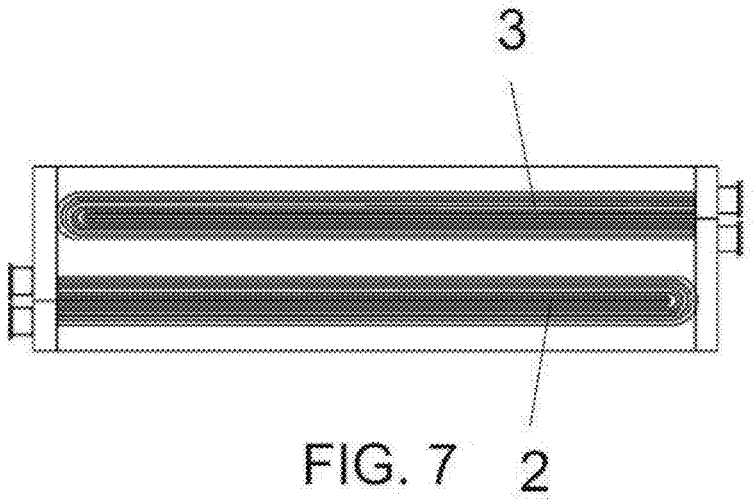
Figure 8:
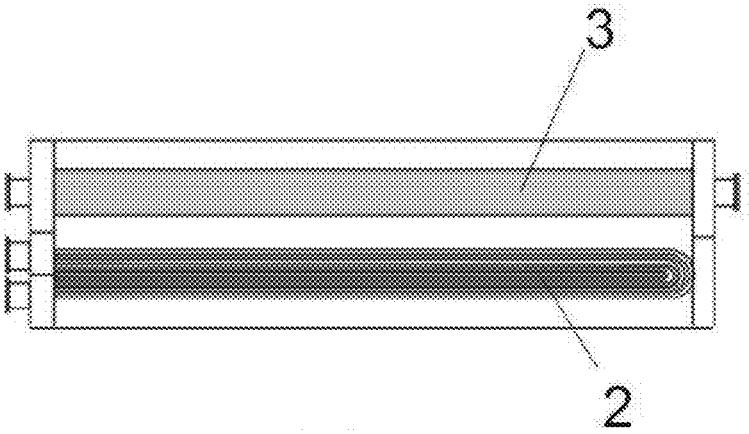
Figure 9:
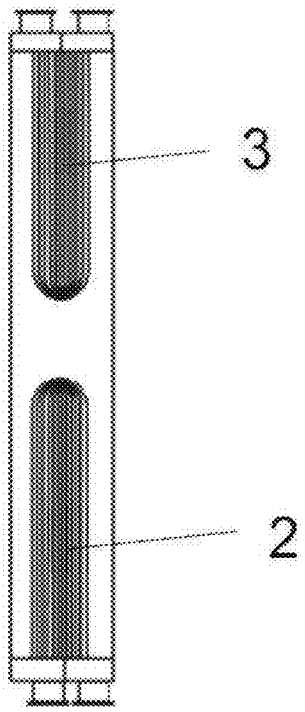
Figure 10:
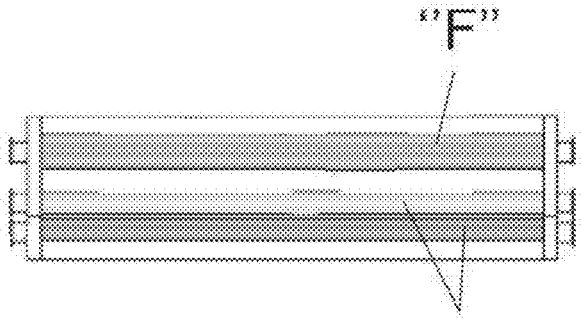
Figure 11:
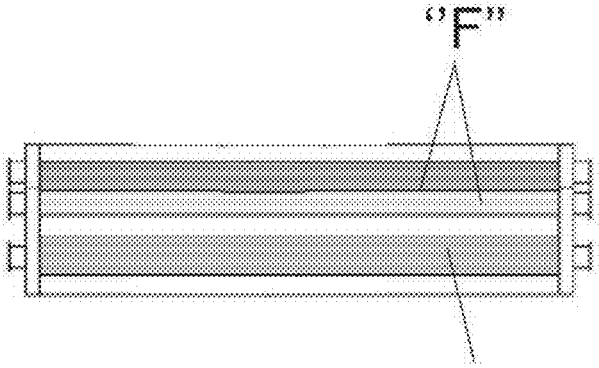
Figure 12:
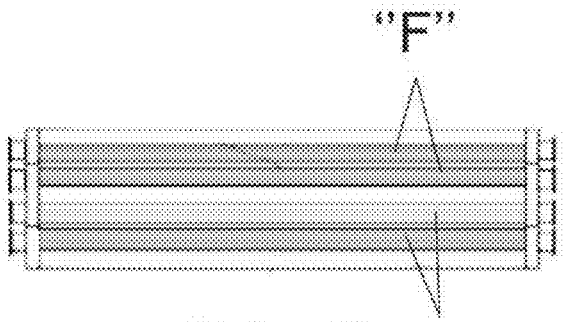
Figure 14:
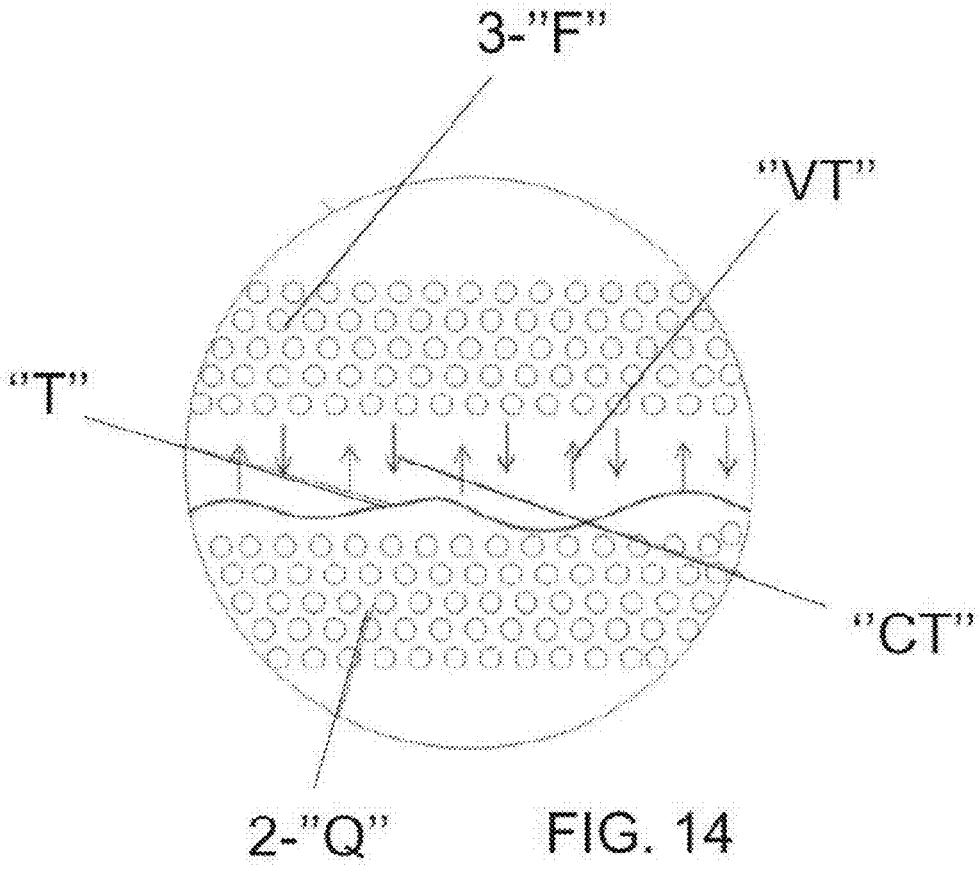
Figure 15:
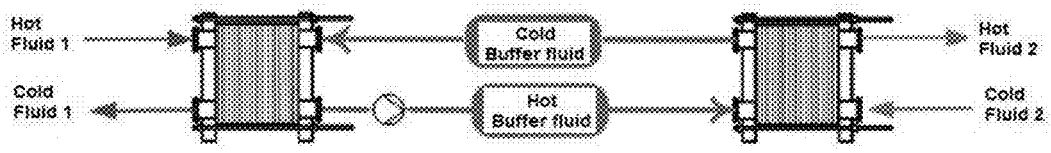
Figure 16:
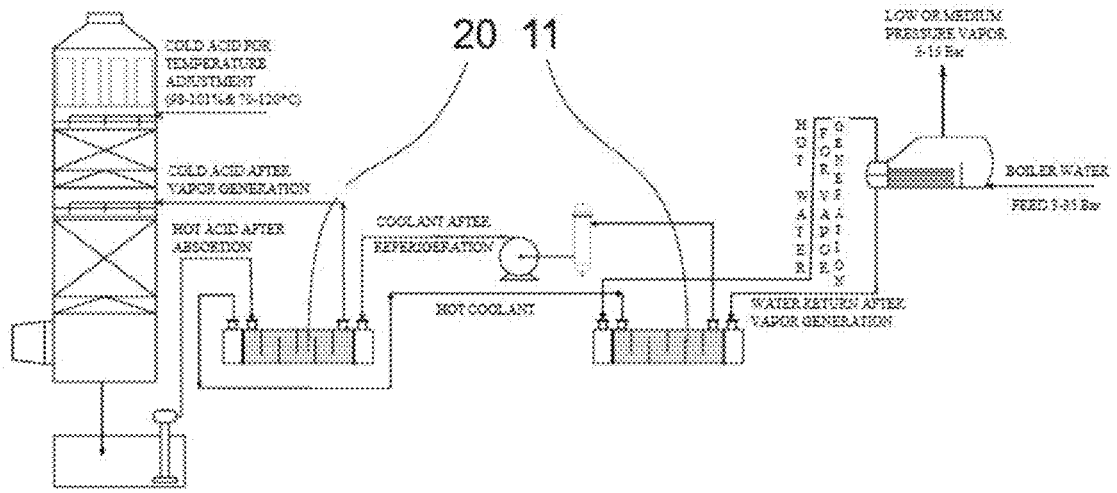

FIGS. 7-9 show various tubing constructions 2 for the hot fluid "Q" to be cooled and tubing 3 for the cold fluid "F" to be heated, which form part of heat exchanger 1;

FIGS. 10-13 show variations of the amounts of process fluids that may be provided in the heat exchanger 1;

FIG. 14 shows a schematic view of the heat exchange process carried out by the heat exchanger 1 of the previous figures;

FIG. 15 shows a schematic view of the "trim coolers" process of the art; and FIG. 16 shows a schematic view of one of the possibilities of the equipment disclosed in the co-pending POT BR 2016/1050287, of the same applicant.

DETAILED DESCRIPTION OF THE DRAWINGS

As illustrated in the above figures, the buffered multi-fluid heat exchanger 1, object of the present invention, is intended for heat exchange between a hot process fluid to be cooled and a cold process fluid to be heated, particularly when these fluids are chemically incompatible with each other, and which, when in contact, could generate exothermic chemical reactions, explosions, formation of undesirable by-products or the loss of the products being heated and cooled or, in case it is interesting or required to ensure a maximum film temperature for the cold fluid to preserve its quality or other characteristics.

Thus, said buffered multi-fluid heat exchanger 1 comprises (FIG. 1): a lower tubing 2 through which a hot process fluid "Q" to be cooled circulates; a tubing 3, through which a cold process fluid "F" to be heated circulates, superior, parallel and spaced relative to the lower tubing 2; a vessel 4 containing said tubing 2 and 3 having inlet 2' and outlet 2" nozzles communicating with respective ends of the tubing 2 through which a hot process fluid "Q" to be cooled circulates, inlet 3' and outlet 3" nozzles communicating with respective ends of the tubing 3, through which a cold process fluid "F" to be heated circulates; said nozzles 2', 2", 3', 3" connected to tubing connected to devices 100, 101 (FIG. 2) using the cold process fluid "R" from the hot process fluid "Q", and the hot process fluid "A" from the cold process fluid "F"; said buffered multi-fluid heat exchanger 1 being further comprised by a buffer fluid "T" portion, which fills part of the vessel 4, and covers the lower tubing 2 through which a hot process fluid "Q" to be cooled circulates.

In detail, tubing 2 and 3 may consist of smooth, finned tubular bundles with longitudinal fins, circumferential fins, helical fins, twisted tubes, or any other type of tube or device suitable and adequate to promote and maximize the thermal exchange between the hot "Q" and cold "F" fluids circulating in tubing 2 and 3 respectively, and the buffer fluid "T".

The equipment is provided with inlet 2', 3' and outlet 2", 3" nozzles of the hot "Q" and cold "F" process fluids, feeding 5 and draining 6 nozzles for the buffer fluid "T", nozzles for instruments, pressure relief valves and the like (not shown) in accordance with all of the good industrial practices and technical standards of the various countries.

Buffer fluid "T" is selected because of its chemical compatibility and boiling temperature in connection with the process fluids "Q" and "F" and its physicochemical characteristics.

The principle of operation of the buffered multi-fluid heat exchanger 1 is extremely simple and benefits from the high heat transfer coefficients obtained during boiling and condensation processes, when compared to the heat transfer coefficients obtained from convection systems.

Thus, (FIG. 2) hot fluid "Q" is received by its inlet nozzle 2' and passes through the tube bundle 2; as this occurs, such fluid transfers heat to the buffer fluid "T", which occupies part of the chamber formed by vessel 4 of the heat exchanger 1. Buffer fluid "T", which has been chosen because of its chemical compatibility and boiling temperature relative to the process fluids "Q" and "F", and its physicochemical characteristics, boils and forms part of the buffer fluid "VT", removing heat from the hot fluid "Q", which is thus cooled and constitutes the cooled fluid "R", which leaves the tube bundle 2 through the outlet nozzles 2", and is fed into the equipment 100 using the cooled fluid "R", at the end of which the fluid turns back into hot process fluid "Q", which is fed back, through inlet nozzles 2', into the buffered multi-fluid heat exchanger 1 and the cycle restarts.

The same occurs substantially with respect to cold fluid "F". Thus, cold fluid "F" is received through its inlet nozzles 3' and passes through tube bundle 3; as this occurs, such fluid receives heat from the buffer fluid vapor "VT", which condenses, forming the buffer fluid "CT" condensate, that is, the buffer fluid "T" returns to the liquid phase, during which heat is transferred to the cold fluid "F", which is thus heated and becomes hot fluid "A", which leaves the tube bundle 3 through outlet nozzle 3", and is fed into the device 101 using hot fluid "A", at the end of which the fluid turns back into cold process fluid "F", which is fed back through inlet nozzle 3' in the buffered multi-fluid heat exchanger 1, and the cycle restarts.

Vapors "VT" resulting from buffer fluid "T" boiling in contact with pipe 2, in which hot fluid "Q" circulates, rise and reach the tube bundle 3 where cold fluid "F" is transported.

Upon reaching this tube bundle 3, where the cold fluid "F" passes, the buffer fluid vapor "VT" is condensed forming buffer fluid "CT" condensate, (buffer fluid "T" in liquid phase) which returns to the buffer fluid body "T" where it is evaporated again by the hot process fluid "Q". The process continues indefinitely.

During this operation, the buffer fluid vapors "VT" rise from boiling in the hot fluid bundle 2, contact the buffer fluid "CT" condensate coming from the cold fluid bundle 3 (upper).

Figure 3:
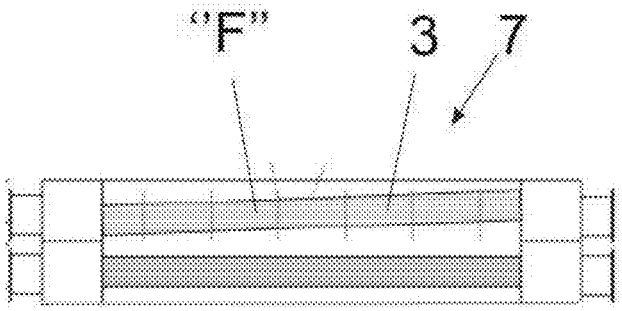
FIGS. 3-6 show various embodiments of a device 7 for reducing the loss of efficiency in the region of contact between the vapor and buffer fluid "T" condensate.
Figure 4:
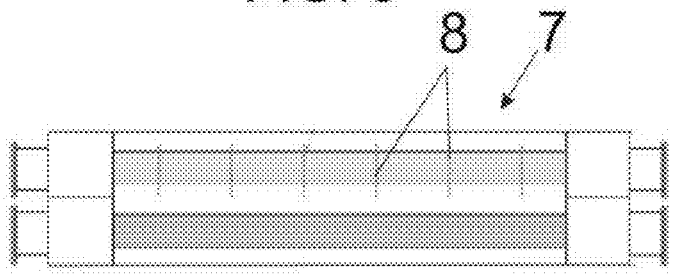

In this movement, some heat exchange may occur between the vapors and buffer fluid "T" droplets, although small, since vapors and liquid are at the same temperature, and therefore the heat transfer driving force is impaired. To eliminate or minimize this effect, a device 7 can be provided to reduce the loss of efficiency in the region of contact between the vapor and buffer fluid "T" condensate. According to one embodiment, this device 7 can consist of the upper tube bundles 3, through which the cold fluid "F" to be heated flows, which may be tilted (FIG. 3) or provided with baffles 8 (FIG. 4) to accelerate and direct draining and the condensate.

Figure 5:
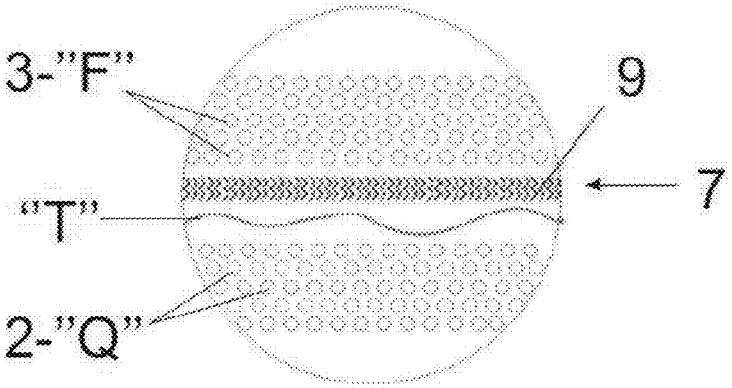
Figure 6:
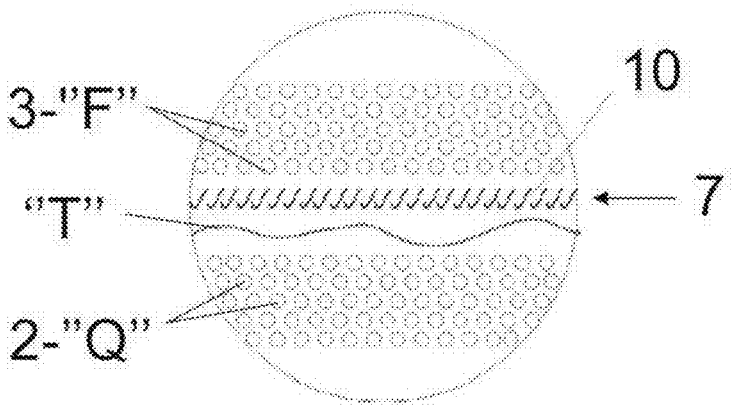

In another embodiment, this device 7 for reducing the loss of efficiency in the region of contact between the vapor and buffer fluid "T" condensate can consist of gas-liquid separating devices, such as fins, Chevron type separators 9 (FIG. 5) or baffle fins 10 (FIG. 6) or others set up in the region between the lower 2 and the top 3 tube bundles, where hot "Q" and cold "F" fluids circulate, respectively.

According to the basic construction described above, the buffered multi-fluid heat exchanger 1 object of the present invention may be subject to changes in materials, dimensions, constructive details and/or functional and configuration without departing from the scope of the protection claimed.

Figure 1:
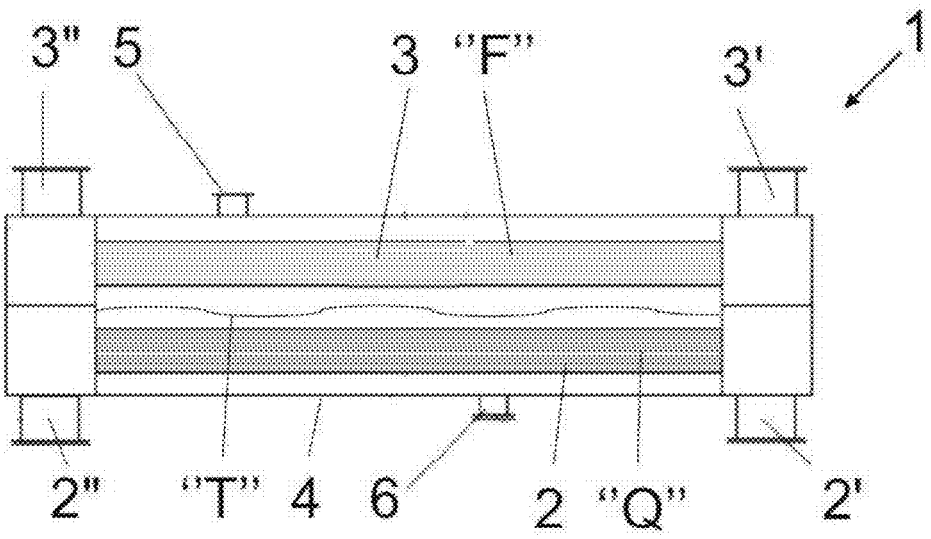
FIG. 1 shows a schematic view of the safety buffered multi-fluid heat exchanger 1.
Figure 2:
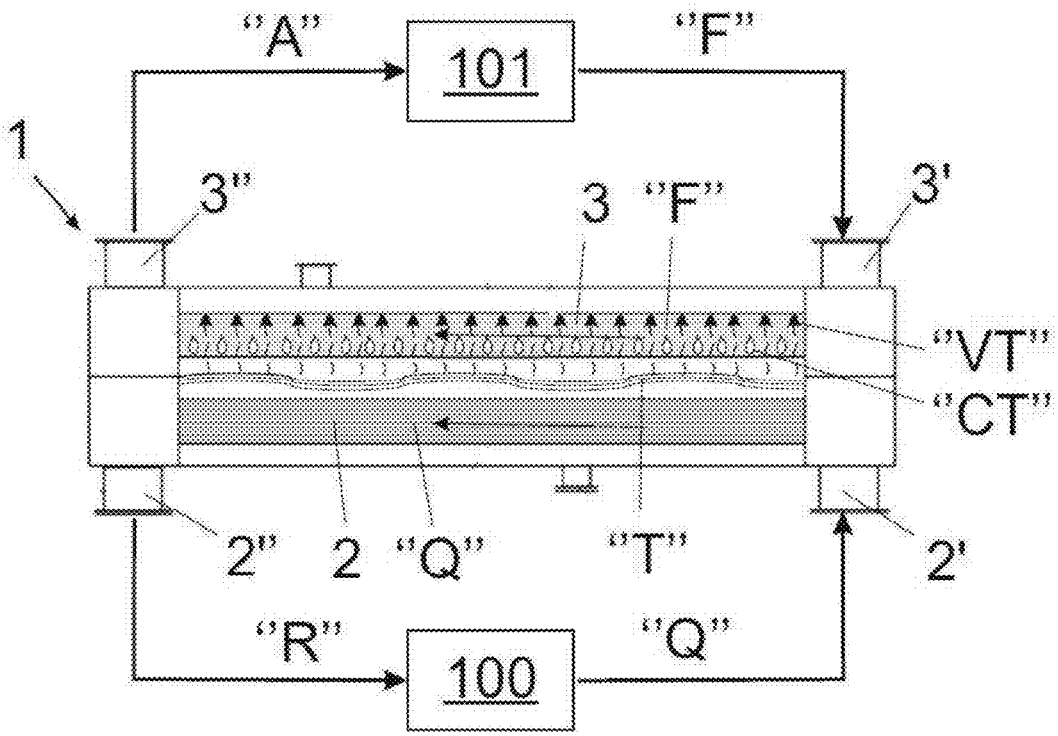
FIG. 2 shows the same FIG. 1 illustrating the operation of the heat exchanger 1.

In addition, the tube bundles 2 and 3 may have a different shape and nature, such as conventional plain tubes, extended surface tubes, conventional longitudinal horizontal beams, as illustrated in FIG. 1, U-type bundles (U-Bundle) (FIG. 7) or a combination thereof mounted horizontally or vertically (FIG. 8, 9).

An important change with respect to conventional exchangers is that in the present buffer fluid heat exchanger 1 with buffer fluid "T", there is no characterization of competing flow, counter-current, cross flow, and other arrangements. The buffer fluid "T" inside the equipment is at its boiling temperature in the process condition, so that the totality of the fluid along the entire length of tubular bundles 2, 3 "sees" the buffer fluid at the same temperature, and therefore the location of the inlet nozzles 2', 3' and outlet nozzles 2", 3" of the equipment and tubular bundles 2, 3 is not important.

Another important advantage that can be achieved with a buffered multi-fluid heat exchanger 1 with buffer fluid "T" is that boiling this fluid limits the temperature at which the hot "Q" or cold "F" fluids are subject to indirect contact; that is, the cold fluid conveying tubes or plates "F" will never "see" a temperature greater than the boiling temperature of the buffer fluid "T"; likewise, the hot fluid "Q" conveying tubes or plates will also not "see" temperatures below that of the buffer fluid "T" and evaporation. This feature allows this buffered multi-fluid heat exchanger 1 to process sensitive fluids or which may undergo decomposition or deterioration due to exposure to high or low temperatures.

Figure 13:
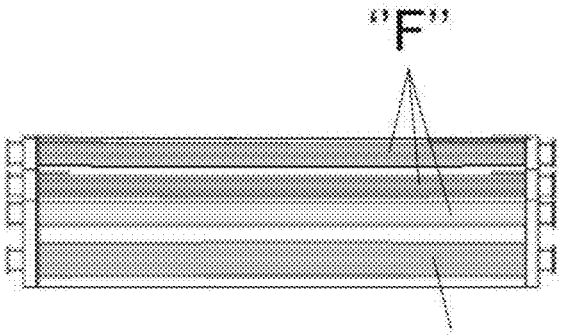

The exchanger may utilize more than two process fluids: for example, two heating fluids "Q" and a cooling fluid "F" (FIG. 10) or two cooling fluids "F" and one heating fluid (FIG. 11), or two of each (FIG. 12) or, in theory, provided that the mechanical construction of the equipment is feasible, as many fluids as desired (FIG. 13).

The proposed devices have been originally conceived to reduce the volume of inert fluid/buffer in indirect sulfuric acid cooling systems as disclosed in the patent application (US Patent Application No. PCT BR 2016 050287) since the proposed arrangement completely eliminates the need for additional equipment and accessory devices, notably pump, tubing, expansion tanks, control instruments, and the like.

However, the technology described here can be used in any system where heating and cooling fluids is necessary, and where, for whatever reason, it is not desirable to have these fluids come into contact in case of a failure, or to limit the film temperature of one of the fluids.

The buffered multi-fluid heat exchanger 1, as described above, performs a safety buffered multi-fluid heat exchange process, comprised essentially of:

providing a lower tube 2 through which a hot process fluid "Q" to be cooled flows;

providing an upper tube 3 through which a cool process fluid "F" to be heated flows, parallel, and which keeps a space with respect to the lower tube 2;

providing an airtight vessel 4 inside which tube bodies (2), (3) are housed and connected to inlet nozzles 2', 3' and outlet nozzles 2", 3", respectively;

providing a portion of the heat transferring buffer fluid inert in relation to hot "Q" and cold "F" fluids, which partially fills vessel 4 and which covers the lower tube 2, through which hot fluid "Q" to be cooled circulates;

providing the steps of (FIG. 2, 14):

Circulation of the hot fluid "Q" to be cooled in the lower tube 2 and circulation of the cold fluid "F" to be heated in the upper tube 3;

Heat exchange between the buffer fluid "T" and the hot fluid "Q" to be cooled flowing in the lower tubing 2 and vaporizing the buffer fluid "T", forming cooled fluid "R" and fluid vapor "VT";

Upward movement of the buffer fluid vapor "VT" until reaching and contacting the upper tube 3 through which the cold fluid "F" to be heated flows;

Heat exchange between the buffer fluid vapor "VT" and the cool fluid "F" to be heated flowing in the upper tube 3, and condensing the buffer fluid vapor "VT", forming heated fluid "A" and buffered fluid "CT" condensate;

Downward movement of the buffer fluid "CT" condensate until it joins the buffer fluid "T" body in the liquid phase and restarting the cycle.

Step of reducing efficiency loss in the contact region between the ascending vapor "VT" and the descending condensate "Q" of fluid buffer "T", taken in the space between tubing 2 through which the hot process fluid "Q" circulates, and tubing 3 through which the cold process fluid "F" circulates.

The invention claimed is:

1. A safety buffered multi-fluid heat exchange process comprising:

tubing (2) through which a hot process fluid "Q" to be cooled flows, tubing (3) through which a cold process fluid "F" to be heated flows, a lower tubing (2) through which the hot process flow "Q" to be cooled circulates;

tubing (3), through which the cold process fluid "F" to be heated flows, arranged superior and spaced relative to the lower tubing (2);

a vessel (4) containing tubing (2) and (3) having opposite inlet (2'), and outlet (2") nozzles communicating with the respective ends of the tubing (2), opposite inlet (3') and outlet (3") nozzles communicating with the respective ends of the tubing (3);

said nozzles (2)', (2)", (3)', (3)" connected to tubing connected to the equipment (100), (101) which use the cold process fluid "R" coming from the hot process fluid "Q" and the hot process fluid "A" coming from the cold process fluid "F";

said buffered multi-fluid heat exchanger (1) further comprising a buffer fluid "T" portion that fills part of the vessel (4), and covers the lower tubing (2) through which the hot process fluid "Q" to be cooled circulates.

2. The safety buffered multi-fluid heat exchange process according to claim 1 wherein the tubings (2) and (3) comprise members selected from the group consisting of: smooth, finned tubular bundles with longitudinal fins, circumferential fins, helical fins, twisted tubes suitable to promote and maximize a thermal exchange between the hot "Q" and cold "F" fluids circulating in tubing (2) and (3) respectively, and the buffer fluid "T".

3. The safety buffered multi-fluid heat exchange process according to claim 1, wherein the buffer fluid "T" is selected based on its chemical compatibility with the process fluids "Q" and "F" and their physicochemical characteristics.

4. The safety buffered multi-fluid heat exchange process according to claim 1, including a device (7) to reduce loss of efficiency in a contact region between a vapor and a buffer fluid "T" condensate, comprising upper tube bundles (3) through which the cold fluid "F" to be heated flows, the bundles being tilted or provided with baffles (8) or said device (7) to reduce loss of efficiency in the contact region between the vapor and the buffer fluid "T" condensate may comprise gas-liquid separating devices, such as fins, Chevron separators (9) or baffle fins (10) set up in the region between the lower (2) and upper (3) tube bundles, where the hot "Q" and cold "F" fluids circulate, respectively.

5. The safety buffered multi-fluid heat exchange process according to claim 1, wherein the tubings (2) and (3) are horizontal, longitudinal, transversal tube bundles (2) and (3), U bundles (U-Bundle), or a combination thereof mounted horizontally or vertically.

6. The safety buffered multi-fluid heat exchange process according to claim 1, including more than two process fluids selected from the group consisting of: two heating fluids "Q" and a cooling fluid "F"; two cooling fluids "F" and a heating fluid; two of each or as many fluids as desired; and that a mechanical construction of an equipment allows.

7. The safety buffered multi-fluid heat exchange process carried out by the heat exchanger (1) as claimed in claim 1 including:

providing a lower tubing (2) through which the hot process fluid "Q" to be cooled flows; providing an upper tubing (3) through which the cold process fluid "F" to be heated flows and which keeps a space with respect to the lower tubing (2);

providing an airtight vessel (4) inside which tube bodies (2), (3) are housed and connected to inlet (2'), (3') and outlet (2"), (3") nozzles, respectively;

providing a portion of the heat transferring buffer fluid "T", inert in relation to hot "Q" and cold "F" fluids, which partially fills vessel (4) and which covers the lower tubing (2), through which hot fluid "Q" to be cooled circulates;

providing the steps of:

circulation of the hot fluid "Q" to be cooled in the lower tubing (2) and circulation of the cold fluid "F" to be heated in the upper tubing (3);

heat exchange between the buffer fluid "T" and the hot fluid "Q" to be cooled flowing in the lower tubing (2) and vaporizing the buffer fluid "T", forming cooled fluid "R" and buffer fluid vapor "T";

upward movement of the buffer fluid vapor "VT" until reaching and contacting the upper tubing (3) through which the cold fluid "F" to be heated flows;

heat exchange between the buffer fluid vapor "VT" and the cool fluid "F" to be heated flowing in the upper tubing (3), and condensing the buffer fluid vapor "VT", forming heated fluid "A" and buffered fluid condensate "CT";

downward movement of the buffer fluid condensate "CT" until it joins the buffer fluid "T" body in the liquid phase and restarting the cycle.

8. The safety buffered multi-fluid heat exchange process according to claim 7, further comprises a step to reduce loss of efficiency in the contact region between the ascending vapor "VT" and the descending condensate "CT" of the buffer fluid "T" performed in the space between tubing (2) through which the hot process fluid "Q" circulates, and tubing (3) through which the cold process fluid "F" circulates, performed by the upper, longitudinal, transversal, flat or tilted tubing (3), and/or featuring baffles (8) or gas-liquid separating devices, such as fins, Chevron separators (9) or baffle fins (10) mounted in the region between the lower (2) and upper (3) tube bundles, where the hot "Q" and cold "F" fluids circulate, respectively.

* * * * *